US005129187A

United States Patent [19]

Cain

[11] Patent Number: 5,129,187

[45] Date of Patent: Jul. 14, 1992

[54] CUE-TIP CONDITIONER

[75] Inventor: Alan Cain, Bedford, Tex.

[73] Assignee: Shark-Fin Products, Inc., Arlington, Tex.

[21] Appl. No.: 454,280

[22] Filed: Dec. 21, 1989

[51] Int. Cl.[5] ..... B24B 11/00

[52] U.S. Cl. ..... 51/181 R; 273/17; 30/494; 51/281 R

[58] Field of Search ..... 51/181 R, 281 R, 204, 51/205 R; 273/17, 18, 19, 20, 21; 30/494

[56] References Cited

U.S. PATENT DOCUMENTS 221,164 11/1879 Fautz ..... 273/17

FOREIGN PATENT DOCUMENTS 296434 11/1928 United Kingdom ..... 273/18

*Primary Examiner*—Roscoe V. Parker

*Attorney, Agent, or Firm*—James E. Bradley

[57] ABSTRACT

A device for conditioning a cue tip roughens the tip and applies chalk. The device has a tubular housing having a closed end and an open end. A concave abrasive sieve is secured to the housing at the open end. The concave side of the sieve faces outward from the housing for abrasive contact with the cue tip. The housing receives a storage cartridge for storing a chalk powder for distribution through the sieve onto the cue tip.

6 Claims, 1 Drawing Sheet

CUE-TIP CONDITIONER

BACKGROUND OF THE INVENTION

1. Field of the Invention

This invention relates in general to devices for applying a chalk powder to a billiard cue tip, and in particular to a device that will shape, condition and apply chalk powder to the cue tip.

2. Description of the Prior Art

Pool and billiard cues typically have a tip that is made of leather. Chalk will normally be applied to the tip to prevent the tip from being too slick. The chalk is generally a small solid cube of chalk having a concave depression formed in it for fitting over the cue tip. Another type of chalking device uses a cylindrical tube containing a cylindrical solid piece of chalk.

During use, the cue tip will become packed and slick. This will cause poor contact with the cue ball. Applying chalk to such a packed cue tip will reduce the slickness. However, it will eventually become out of shape and have excessive chalk buildup on the tip.

There are various abrasive devices that have concave shapes with abrasive surfaces for conditioning a tip. However, these devices do not apply chalk. Applying chalk with a conventional piece of chalk to a newly roughened tip results in an uneven application of chalk.

SUMMARY OF THE INVENTION

In this invention, a cue tip conditioner is provided that will not only roughen and shape the tip, but will apply a powdered chalk to the roughened fibers of the leather tip. The conditioner has a housing with an open end. An abrasive screen or sieve locates at the open end for contact with the cue tip. The sieve has a concave surface that faces outward from the housing. The concave surface will have an abrasive type material or design to provide a rasping action on the tip. Rotating the abrasive concave surface of the device against the leather tip will shape the tip to have the same radius as the sieve.

Chalk powder will be placed inside the housing, preferably within a tube. Tapping the end of the housing opposite the sieve will cause chalk powder to pass through the sieve and onto the cue tip. Holes in the sieve allow passage of the powdered chalk to coat the fibers and grooves made by the concave surface.

DETAILED DESCRIPTION OF THE INVENTION

Figure 1:
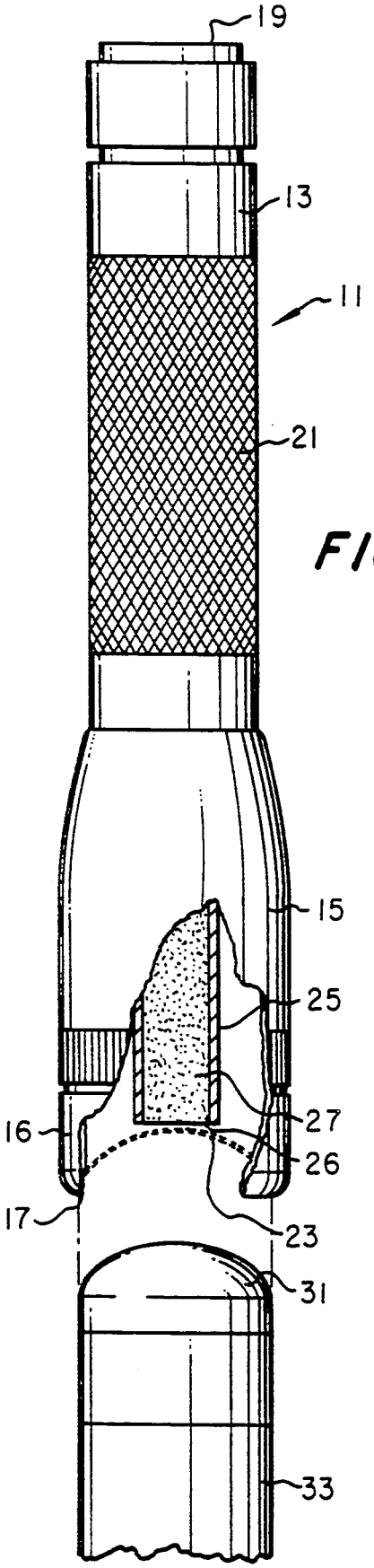
FIG. 1 is a side elevational view, partially sectioned, of a cue-tip conditioner constructed in accordance with this invention.

Referring to FIG. 1, cue-tip conditioner 11 is a small, hand-held device. It has a tubular housing 13. The housing 13 has an enlarged section 15 on one end. The enlarged section 15 terminates in an open end 17. A ring 16 secures by threads to the open end 17. Housing 13 has a closed end 19 opposite the open end 17. Housing

13 has a knurled section 21 on its exterior to facilitate rotating the housing 13.

Figure 4:
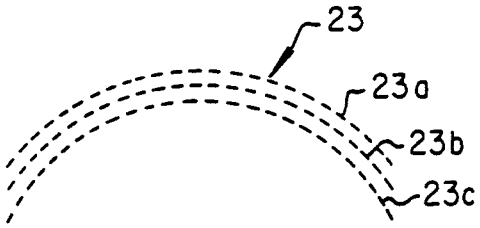
FIG. 4 is an exploded view showing the three layers of the sieve used with the conditioner of FIG. 1.
Figure 2:
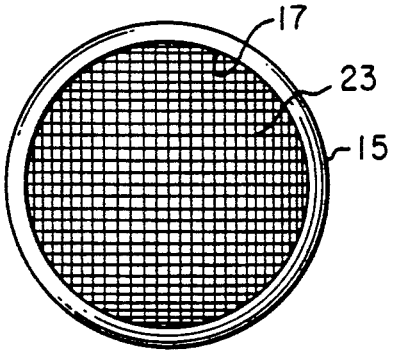
FIG. 2 is an end view of the cue-tip conditioner of FIG. 1.

A concave sieve 23 is secured to the housing 13 open end 17, as shown also in FIG. 2. As illustrated in FIG. 4, sieve 23 comprises in the preferred embodiment three separate wire mesh layers or screens 23*a*, 23*b* and 23*c*. Each layer 23*a*, 23*b*, and 23*c* is bent into a concave, semi-spherical shape. The mesh of the inner two layers 23*a*, 23*b* is finer than the mesh of the outer layer 23*c*, which has larger holes. The sieve 23 curves inward into the housing 13, with the concave side facing outward from the housing 13. The layers 23*a*, 23*b* and 23*c* are preferably of stainless steel and are fairly hard. Also, preferably the outer sieve layer 23*c* is coated with an abrasive substance. The sieve 23 is retained by the ring 16.

A plastic tube or cartridge 25 locates within the interior of the housing 13. Cartridge 25 will slide into the interior when the ring 16 is removed. Cartridge 25 has an open end 26 which will contact the sieve 23. The cartridge 25 will receive and store chalk powder 27. Normally, the cartridge 25 will be filled with the chalk powder 27 while the cartridge 25 is out of the housing 13. The end 26 will be open when the cartridge 25 is placed in the housing 13. The end (not shown) of the cartridge 25 opposite the open end 26 comes into contact with the closed end 19. Tapping on the closed end 19 will cause chalk powder 27 to flow downward by gravity through the sieve 23.

Figure 3:
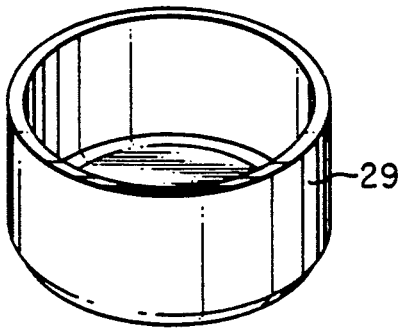
FIG. 3 is a perspective view of a cap for use with the conditioner of FIG. 1.

FIG. 3 shows a cap 29 that will secure over the open end 17 of the housing 13. Cap 29 will fit by a friction fit. Cap 29 prevents chalk from spilling from the housing 13 when the conditioner 11 is not in use.

The tip conditioner 11 will be used for conditioning a leather tip 31 of a billiard or pool cue 33. Tip 31 is conventional. It has cylindrical sidewalls and a spherical end. The radius of the spherical sieve 23 will create the same radius on the end of the cue tip 31 when the tip conditioner 11 is used.

In operation, when the user wishes to condition the tip 31, he removes the cap 29. He places the sieve 23 into contact with the tip 31. He will rotate tip conditioner 11 while holding the cue 33 stationary. The sieve 23 will roughen the exterior and dislodge any packed chalk. The rasping movement will remove slickness from the tip 31 and will shape the tip 31.

He will tap gently on the closed end 19 to dislodge chalk powder 27 from the cartridge 25. The powder 27 will flow through the sieve 23 and onto the cue tip 31. The sieve layers 23*a*, 23*b* control the flow of powdered chalk. The chalk powder 27 will coat the cue tip 31 to provide a base coat on the conditioned surface. The powdered chalk 27 will coat all sides of the protruding fibers of the leather tip 31. This gives a more uniform coating than if conventional chalk is used. Conventional chalk tends to press the fibers of the tip 31 down immediately, coating only one side of them. He will then replace the cap 29 to prevent spillage of chalk powder 27.

Preferably, the user will then add additional chalk from a conventional solid chalk member. He will utilize the conventional chalk generally before every shot. After two or three games, he will again use the tip conditioner 11 in the same manner as above.

The invention has significant advantages. The tip conditioner applies powdered chalk more uniformly than the prior art solid chalk. The base coat applied by the tip conditioner helps chalk applied by a conventional solid chalk member to adhere better.

While the invention has been shown in only one of its forms, it should be apparent to those skilled in the art that it is not so limited, but is susceptible to various changes without departing from the scope of the invention.

I claim:

1. A device for conditioning a cue tip, comprising in combination:

a housing having means for storing powdered chalk and having an open end;

means including a concave sieve located at the open end for abrasive contact with the cue tip and for distributing the powdered chalk onto the cue tip; and the sieve having a plurality of separate layers, each of the layers having a plurality of holes therethrough, and wherein the holes in at least one of the layers are smaller than the holes in the other.

2. The device according to claim 1 wherein the sieve is a metal screen for abrading contact with the cue tip when the housing is rotated.

3. A device for conditioning a cue tip, comprising in combination:

a tubular housing having a closed end and an open end;

a concave abrasive sieve secured to the housing at the open end and facing outward from the housing for abrasive contact with the cue tip;

storage means in the housing for storing a chalk powder for distribution through the sieve onto the cue tip; and the storage means comprising a cartridge located within the housing for receiving the chalk powder, the cartridge having an open end which contacts the sieve.

4. The device according to claim 3 further comprising:

a cap releasably mounted to the open end of the housing for preventing spillage of powder through the sieve while the device is not in use.

5. A method for conditioning a cue tip, comprising in combination:

providing a housing with an open end;

securing a concave abrasive sieve at the open end;

placing a chalk powder in the housing in communication with the sieve;

placing the cue tip in contact with the sieve, and rotating the cue tip and housing relative to each other to abrade the cue tip; and distributing the chalk powder through the sieve onto the cue tip.

6. The method according to claim 5 wherein the step of distributing the chalk powder through the sieve onto the cue tip includes tapping an end of the housing opposite the open end to cause chalk powder to fall through the sieve.

* * * * *